US009305447B2

(12) United States Patent
Copeland et al.

(10) Patent No.: US 9,305,447 B2
(45) Date of Patent: Apr. 5, 2016

(54) ELECTRONIC ARTICLE SURVEILLANCE TAG DEACTIVATION

(71) Applicant: Sensormatic Electronics, LLC, Boca Raton, FL (US)

(72) Inventors: Richard Loyd Copeland, Lake Worth, FL (US); Ming-Ren Lian, Boca Raton, FL (US)

(73) Assignee: Tyco Fire & Security GmbH, Neuhausen am Rheinfall (CH)

( * ) Notice: Subject to any disclaimer, the term of this patent is extended or adjusted under 35 U.S.C. 154(b) by 706 days.

(21) Appl. No.: 13/706,673

(22) Filed: Dec. 6, 2012

(65) Prior Publication Data

US 2014/0159901 A1 Jun. 12, 2014

(51) Int. Cl.

| | |
|---|---|
| ***H01Q 21/20*** | (2006.01) |
| ***G08B 13/24*** | (2006.01) |
| ***H01Q 9/16*** | (2006.01) |
| ***H01Q 1/22*** | (2006.01) |
| ***H01Q 21/06*** | (2006.01) |
| ***H01Q 21/29*** | (2006.01) |

(52) U.S. Cl.

CPC ..... *G08B 13/2468* (2013.01); *H01Q 1/2216* (2013.01); *H01Q 9/16* (2013.01); *H01Q 21/062* (2013.01); *H01Q 21/29* (2013.01)

(58) Field of Classification Search

CPC ... H01Q 21/29; H01Q 1/2216; G08B 13/2468

USPC ..... 343/795, 700 MS, 893, 810, 843, 799

See application file for complete search history.

(56) References Cited

U.S. PATENT DOCUMENTS

| | | | | |
|---|---|---|---|---|
| 5,061,941 | A | 10/1991 | Lizzi et al. | |
| 5,142,292 | A | 8/1992 | Chang | |
| 7,109,867 | B2 | 9/2006 | Forster | |
| 7,893,887 | B2 * | 2/2011 | Burns | G06K 7/10336 343/793 |
| 8,013,742 | B2 | 9/2011 | Lian et al. | |
| 2001/0035844 | A1 * | 11/2001 | Reece | H01Q 9/285 34/810 |
| 2007/0080884 | A1 * | 4/2007 | Boss | H01Q 1/246 343/799 |
| 2007/0216594 | A1 * | 9/2007 | Uno | H01Q 3/06 343/770 |
| 2008/0007478 | A1 * | 1/2008 | Jung | H01Q 1/38 343/895 |
| 2010/0039343 | A1 * | 2/2010 | Uno | H01Q 3/24 343/818 |

* cited by examiner

*Primary Examiner* — Hoanganh Le

(74) *Attorney, Agent, or Firm* — Alan M. Weisberg; Christopher & Weisberg, P.A.

(57) ABSTRACT

A method and system for producing an electromagnetic field that exhibits a strong near field that is sufficient to deactivate an electronic article surveillance, EAS, tag and a weak far field that is insufficient to deactivate the EAS tag are disclosed. According to one embodiment, two half-wavelength dipoles spaced apart by about a half-wavelength are excited by oppositely phased signals.

19 Claims, 11 Drawing Sheets

ELECTRONIC ARTICLE SURVEILLANCE TAG DEACTIVATION

FIELD

The present invention relates to generation of an electromagnetic field that has a strong near field for deactivating an electronic article surveillance tag, and that has a weak far field.

BACKGROUND

Articles of commerce are often tagged with an electronic article surveillance, EAS, tag that can be detected by an antenna system that is situated at an exit of a store that sells the articles of commerce. When an article having an EAS tag that has not been deactivated passes a security checkpoint, an alarm is generated. In order to prevent setting off the alarm, a tag of a purchased article is deactivated at a point of sale. In one type of tag, deactivation is accomplished by exposing the tag to a high frequency, UHF, signal of an antenna that induces a voltage across a metal-oxide semiconductor, MOS, device that exceeds the breakdown voltage of the MOS device, thereby destroying the MOS device and achieving deactivation. For example, such a tag is described in U.S. Pat. No. 8,013,742, entitled "Metal Oxide Semiconductor Device for Use in UHF Electronic Article Surveillance System." The typical breakdown voltage is around 5 volts and an E field at resonance of about 70 Volts/meter is required for breakdown to occur.

A disadvantage of some known deactivation antennas is the high far field emitted from these antennas which may interfere with surrounding electronic equipment and may violate regulatory emission rules, for example, those promulgated by the Federal Communication Commission, FCC. Also, some tags located behind a preferred zone near a deactivator may be inadvertently deactivated.

SUMMARY

The present invention advantageously provides a method and system for producing an electromagnetic field that exhibits a strong near field that is sufficient to deactivate an electronic article surveillance, EAS, tag and a weak far field that is insufficient to deactivate the EAS tag. The electric field increases near the deactivator while being cancelled in the far field region, allowing an increase of input power while still meeting regulatory limits in the far field. According to one aspect, a near field antenna includes a first antenna element and a second antenna element. The first antenna element has a dimension that is about a half wavelength of an excitation frequency. The excitation frequency is carried by a first signal that is applied to the first antenna element with a first relative phase. The second antenna element has a dimension that is about a half wavelength of the excitation frequency. The first signal is applied to the second antenna element with a second relative phase of about 180 degrees from the first relative phase. The second antenna element is displaced from the first antenna element by about half a wavelength of the excitation frequency.

According to another embodiment, the invention provides a method of producing an electromagnetic field for deactivating an electronic article surveillance, EAS, tag, the electromagnetic field having a strong near field that is sufficient to deactivate the EAS tag and a weak far field that is insufficient to deactivate the EAS tag. The method includes providing an excitation frequency and an array of dipole elements. Each dipole element has a dimension of about a half wavelength of the excitation frequency. The array of dipole elements has a dipole element spacing of about a half wavelength. The method includes applying the excitation frequency to the array of dipole elements so that pairs of dipole elements in the array are phased apart by about 180 degrees.

According to another aspect, the invention provides a near field antenna system for deactivation of an electronic article surveillance tag. The near field antenna includes a first antenna element having a dimension of about 160 millimeters (mm) and a second antenna element having a dimension of about 160 mm. The second antenna element is spaced apart from the first antenna element by a dimension in a range of 100 mm to 250 mm. A signal generator generates an excitation signal in a range of about 800 to about 1000 Megahertz (MHz). The excitation signal is applied to the first and second antenna elements so that a phase of excitation of the first antenna is about 180 degrees from a phase of excitation of the second antenna element.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION

Figure 1:
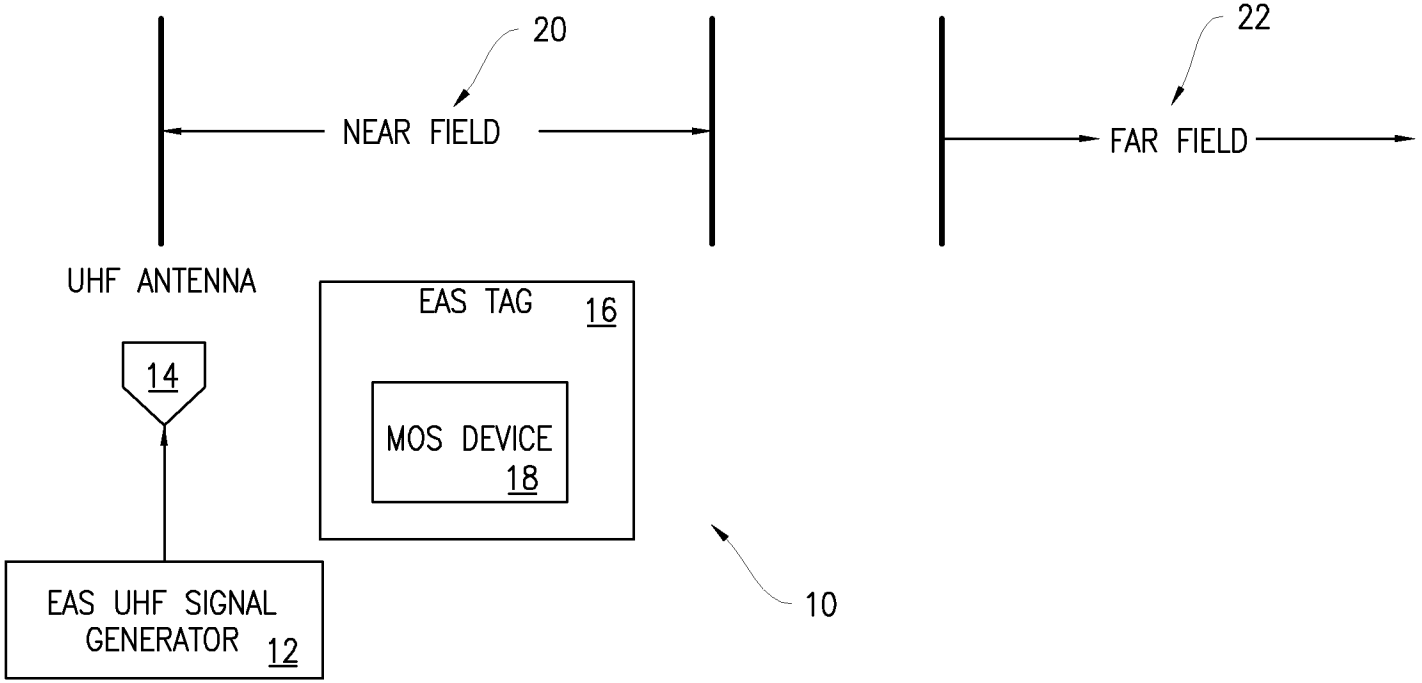
FIG. 1 is a diagram of an exemplary embodiment of a system for providing a near field sufficient to deactivate an electronic article surveillance, EAS, tag constructed in accordance with principles of the present invention.

Before describing in detail exemplary embodiments that are in accordance with the present invention, it is noted that the embodiments reside primarily in combinations of apparatus components and processing steps related to generating an electromagnetic field for deactivating an electronic article surveillance, EAS, tag. Accordingly, the system and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

As used herein, relational terms, such as "first" and "second," "top" and "bottom," and the like, may be used solely to distinguish one entity or element from another entity or element without necessarily requiring or implying any physical or logical relationship or order between such entities or elements.

Referring now to the drawing figures, in which like reference designators denote like elements, there is shown in FIG. 1 an exemplary embodiment of a system 10 for providing a near field sufficient to deactivate an electronic article surveillance, EAS, tag 16. The system 10 includes an EAS signal generator 12 which may be, for example, a ultra-high frequency, UHF, generator. In some embodiments, the EAS signal generator 12 may generate a signal having a frequency in the range of between 800 and 1000 Megahertz (MHz). However, the EAS signal generator 12 may generate signals at other frequencies.

The EAS signal generator 12 is in communication with an antenna 14. The antenna 14 operates at a frequency generated by the EAS signal generator 12. For example, the antenna 14 may be a UHF antenna operating in the frequency range of between about 800 and about 1000 MHz. The antenna 14 radiates a signal that can reach the EAS tag 16 when the EAS tag is in the near field 20 of the antenna 14. The near field 20 of the antenna 14 is a distance that is less than a about a wavelength of the signal applied to the antenna 14 by the EAS signal generator 12.

The antenna 14 is constructed according to principles of the present invention to radiate a strong signal in the near field 20 that is of sufficient strength to deactivate an EAS tag in the near field, and to radiate a weak signal in the far field 22 that is of insufficient strength to deactivate an EAS tag in the far field. The far field 22 is a distance that is greater than about two wavelengths of the signal applied to the antenna 14 by the EAS signal generator 12. When the EAS tag 16 is in the near field 20, the electromagnetic field of the antenna 14 is of sufficient strength to induce a voltage across a MOS device 18 of the EAS tag 16 that exceeds the breakdown voltage of the MOS device 18, which is typically about 5 volts, thereby destroying the MOS device 18 and deactivating the EAS tag 16. The E field associated with the breakdown voltage of 5 volts is about 70 V/m.

Figure 2:
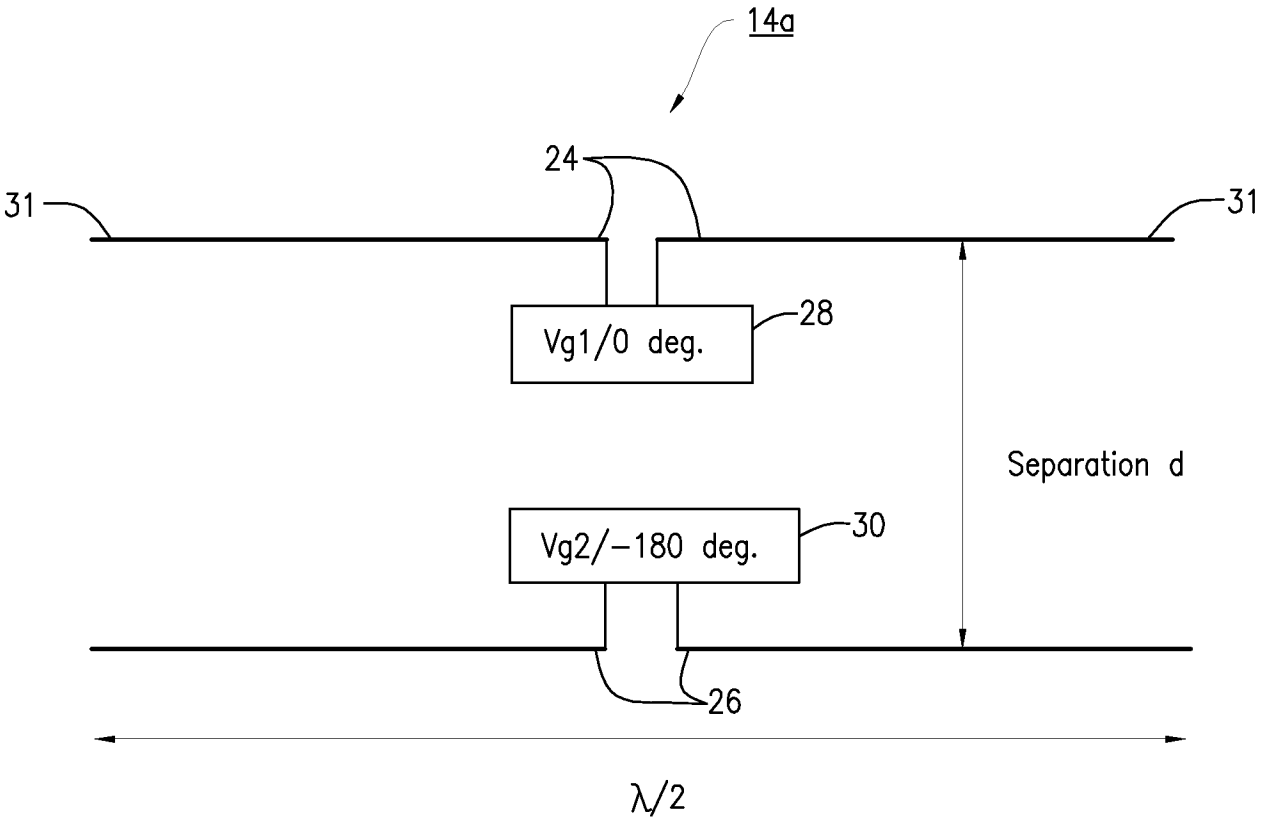
FIG. 2 is a diagram of an exemplary embodiment of an antenna for deactivating an EAS tag constructed in accordance with principles of the present invention.

FIG. 2 is a diagram of an exemplary embodiment of an antenna 14*a* for deactivating an EAS tag 16. The antenna 14*a* includes a first antenna element 24 and a second antenna element 26. The first antenna element 24 and the second antenna element 26 each have a dimension of about a half wavelength of the excitation frequency of the signal applied to the antenna 14*a*. The first and second antenna elements 24 and 26 may be separated by a distance d that is about a half wavelength of the excitation frequency. The excitation signal from the signal generator 12 may be applied at a first port 28 at a relative phase of zero degrees to excite the first antenna element 24. The excitation signal from the signal generator 12 may be applied at a second port 30 at a phase of 180 degrees relative to the excitation applied to the first port 28, to excite the second antenna element 26.

In one embodiment, the antenna elements 24 and 26 are dipole elements, each having a current that is zero at the ends 31 of the dipole element and having a current that is maximum at the center of the dipole element.

As an EAS tag 16 is swept over the antenna 14*a*, first passing over the first antenna element 24 and then passing over the second antenna element 26, the electric field experienced by the EAS tag 16 will peak above the first antenna element 24, and decrease to substantially zero directly above the space between the first antenna element 24 and the second antenna element 26. The field experienced by the EAS tag 16 will again peak over the second antenna element 26 as the EAS tag 16 passes over the second antenna element 26. Thus, a tag is swept across the deactivator to achieve deactivation.

The peak electric field experienced by the EAS tag 16 is preferably of sufficient strength to deactivate the EAS tag 16 when the EAS tag is in the near field 20 of the antenna 14*a*. When the distance between the antenna 14*a* and the EAS tag 16 is much larger than the distance of separation d, the electric fields of each of antenna elements 24 and 26 tend to cancel one another to produce a field that is substantially zero in the far field 22 of the antenna 14*a*. Thus, the power of the applied excitation field from the signal generator 12 can be increased to above 1 Watt rms to produce a field that is of sufficient strength in the near field 20 to deactivate the EAS tag 16, but that is sufficiently weak to avoid exceeding power levels specified by regulations promulgated by a regulatory body such as the Federal Communication Commission, FCC.

In one embodiment, the applied excitation frequency of the signal generator is 915 MHz. Assuming that the dipoles 24 and 26 are on a substrate having a dielectric constant that is about equal to the dielectric constant of air, the overall length of the dipoles 24 and 26 should be about 160 millimeters (mm). The separation, d, between the dipoles 24 and 26 may be between about 100 mm and 150 mm. In some embodiments the separation, d, may be as great as about 250 mm.

Figure 3:
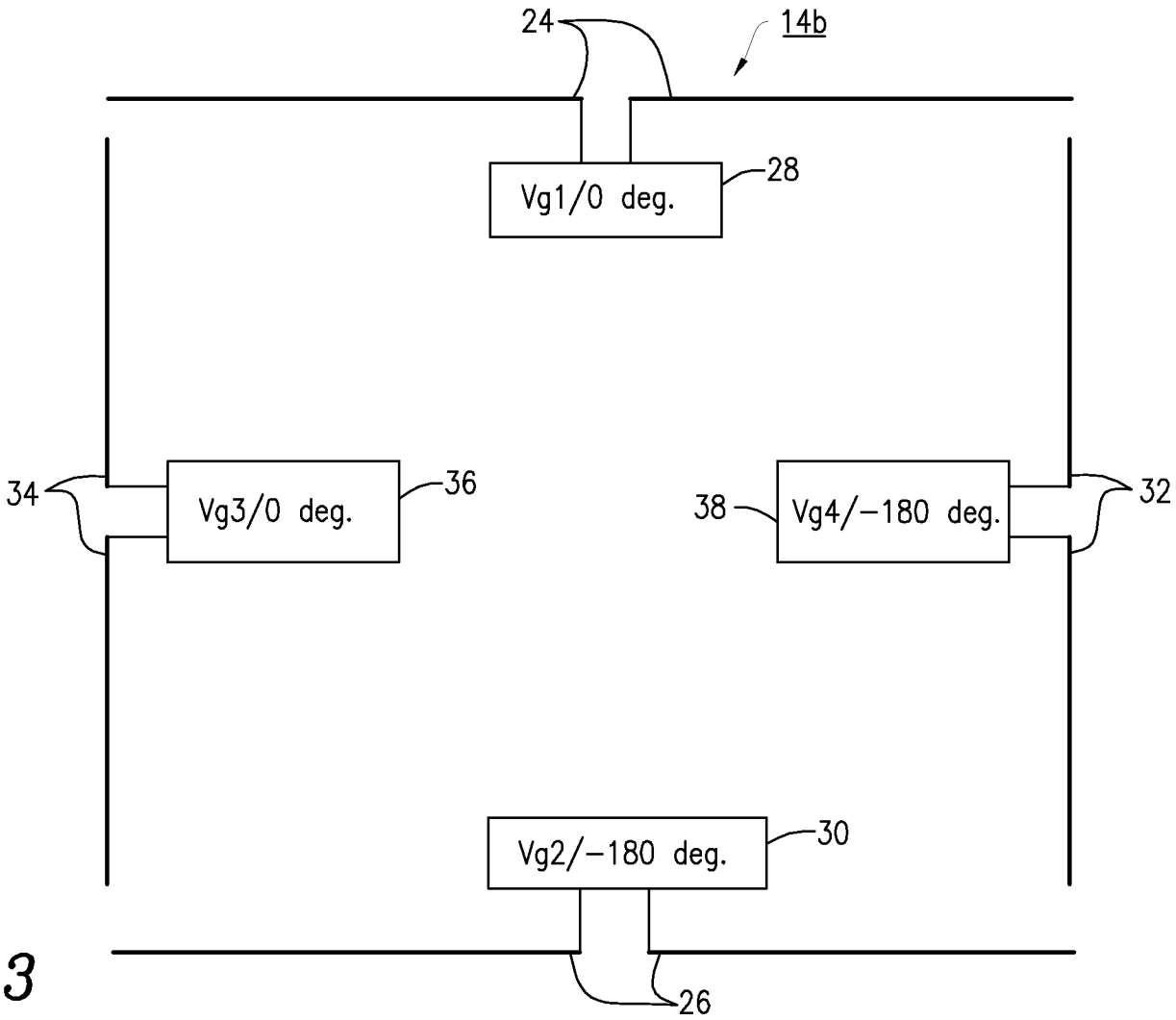
FIG. 3 is a diagram of an alternative embodiment of an antenna for deactivating an EAS tag constructed in accordance with principles of the present invention.

FIG. 3 is a diagram of an alternative embodiment of an antenna for deactivating an EAS tag constructed in accordance with principles of the present invention. The antenna 14*b* includes an array of antenna elements that include a first antenna element 24 and a second antenna element 26. The first antenna element 24 and the second antenna element 26 each have a dimension of about one half the wavelength of the excitation frequency of the signal applied to the antenna 14*b*. The first and second antenna elements 24 and 26 may be separated by a distance, d, that is about a half wavelength of the excitation frequency. The excitation signal from the signal generator 12 may be applied at a first port 28 at a relative phase of zero degrees to excite the first antenna element 24. The excitation signal from the signal generator 12 may be applied at a second port 30 at a phase of about 180 degrees relative to the excitation applied to the first port 28, to excite the second antenna element 26.

The antenna 14*b* also has two additional antenna elements 32 and 34 oriented substantially at right angles to the antenna elements 24 and 26. The antenna element 34 is excited at a port 36 by the excitation signal generated by the signal generator 12 at a relative phase of zero degrees. The antenna element 32 is excited at a port 38 by the excitation signal generated by the signal generator 12 at a relative phase that differs by about 180 degrees from the phase of the excitation applied at the port 36. Each antenna element 32 and 34 have a dimension that is about a half wavelength of the applied excitation frequency, and the antenna elements 32 and 34 are separated by the distance, d, that is about a half wavelength of the applied excitation frequency.

In some embodiments, excitation of the antenna elements 24 and 26 is temporally alternated with excitation of the antenna elements 32 and 34. Thus, in first time interval, t1, the excitation is applied to antenna elements 24 and 26, whereas in a second subsequent time interval, t2, the excitation is applied to antenna elements 32 and 34. By temporally alternating the excitation, the substantial null of the near E-field between the antenna elements is at least partially overcome, thereby substantially eliminating the orientation dependency exhibited by the antenna 14*a* of FIG. 2. The null occurs in the middle region of the deactivator so that as a tag is swept across the deactivator at any angle over the deactivator up to a certain height, successful deactivation occurs.

A difference between the antenna 14*a* and the antenna 14*b* is that the electric field of the antenna 14*b* is substantially omni-directional above a plane containing the four antenna elements 24, 26, 32 and 34, whereas the magnitude of the electric field of the antenna 14*a* exhibits substantial orientation dependence, because of the substantial null directly above the center between the antenna elements 24 and 26. Nevertheless, the electric field of the antenna 14*b* is of sufficient strength in the near field 20 to deactivate an EAS tag 16, but is of insufficient strength in the far field 22 to exceed regulatory constraints. Indeed, the power applied to the antennas 14*a* or 14*b* can be substantially increased while still maintaining a small far field electric field intensity.

In an alternative embodiment, the excitations of the antennas 24, 26, 32 and 34 are alternated so that the phase of an antenna is 90 degrees from the phase of an adjacent antenna. For example, in one time interval the phase of antenna 26 is zero degrees, the phase of the antenna 32 is 90 degrees, the phase of the antenna 24 is 180 degrees, and the phase of the antenna 34 is 270 degrees.

Figure 4:
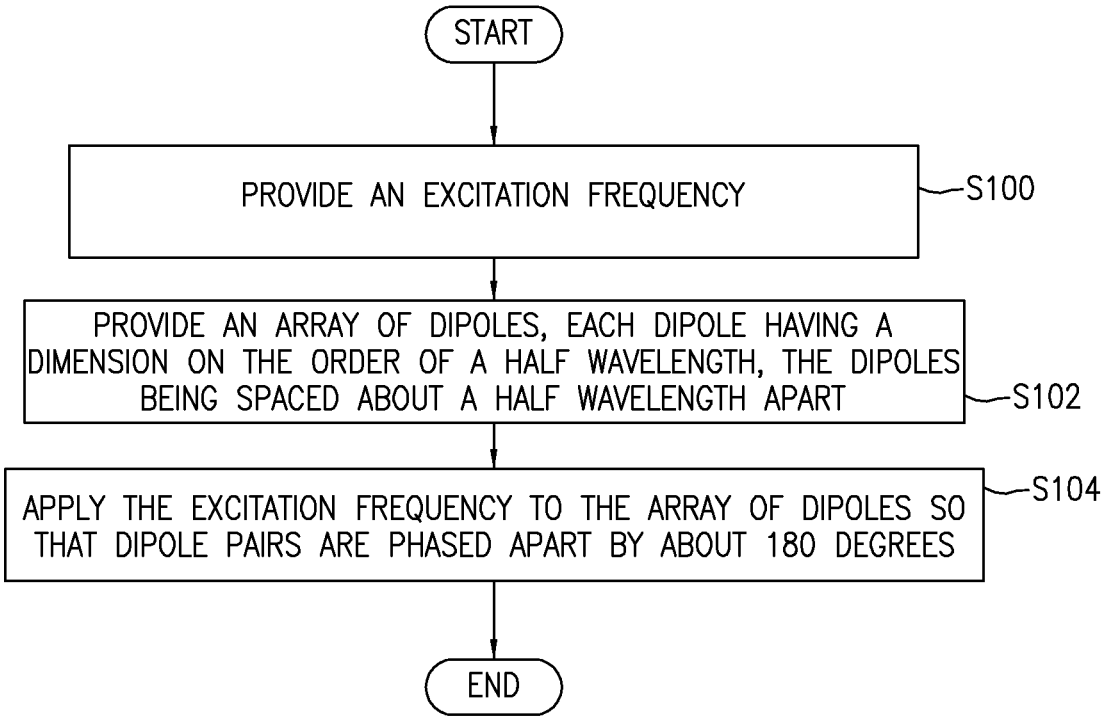
FIG. 4 is a flowchart of an exemplary process for producing a near field to deactivate an EAS tag.

FIG. 4 is a flowchart of an exemplary process for producing a near field to deactivate an EAS tag. An excitation signal at a frequency that can deactivate an EAS tag is provided (S100). An array of antenna elements, such as dipoles, are provided. The antenna elements exhibit a dimension that is about a half wavelength, and are separated by about a half wavelength (S102). The excitation frequency is applied to the array of antenna elements so that oppositely directed antenna elements are phased apart by about 180 degrees (S104).

Figure 5:
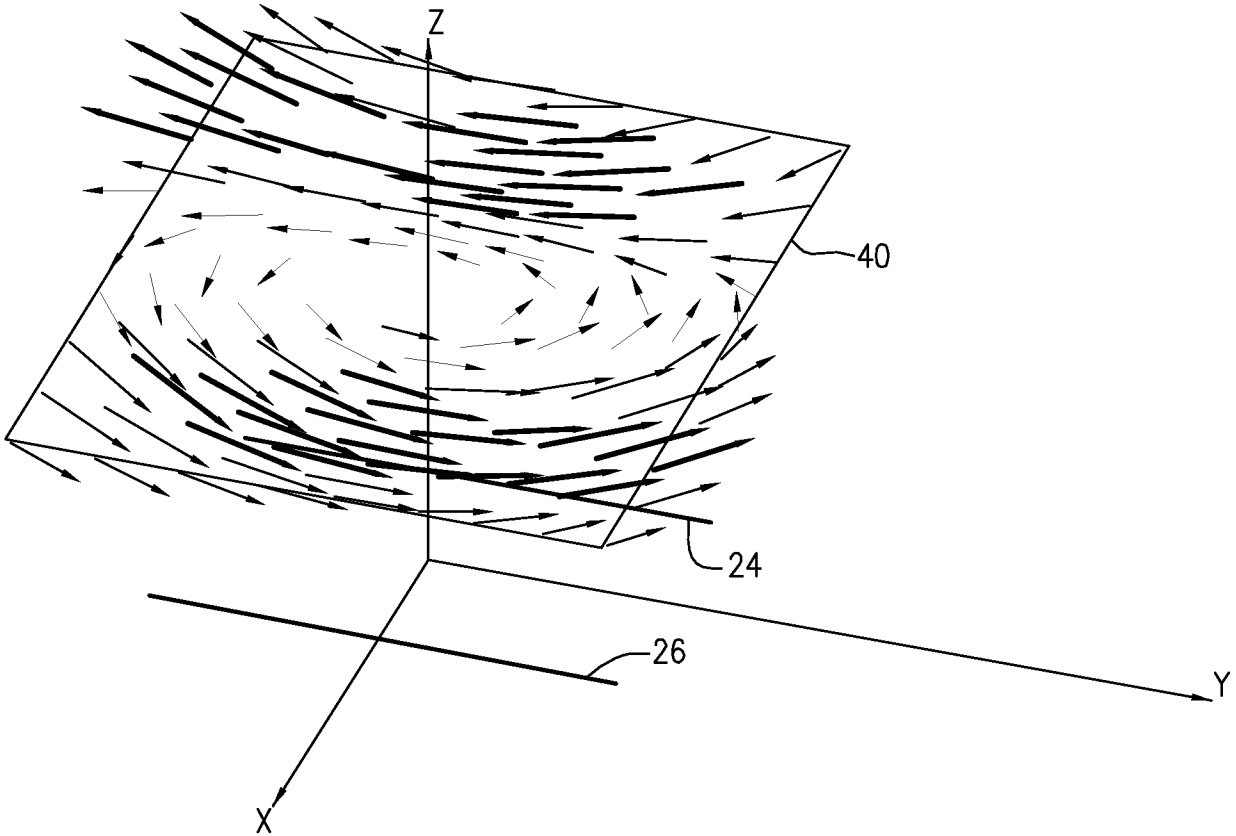
FIG. 5 is a graph of an electric field in a near field plane above the antenna elements shown in FIG. 2 for a 10 centimeter (cm) height and a 100 millimeter (mm) separation.

FIG. 5 is an illustration of the electric field in a near field plane 40 that is 10 centimeters (cm) above the antenna depicted in FIG. 2 for the distance, d, being 100 millimeters (mm). The thickness and density of the arrows in FIGS. 5, 6 and 8-11 are indicative of the intensity of the electric field. In particular, greater thickness and density indicates higher electric field intensity. The directions of the arrows indicate the direction of the electric field. As can be seen in FIG. 5, the electric field directly above each antenna element 24 and 26 are opposite in phase and the magnitudes of the field above each antenna are equal and opposite.

Figure 6:
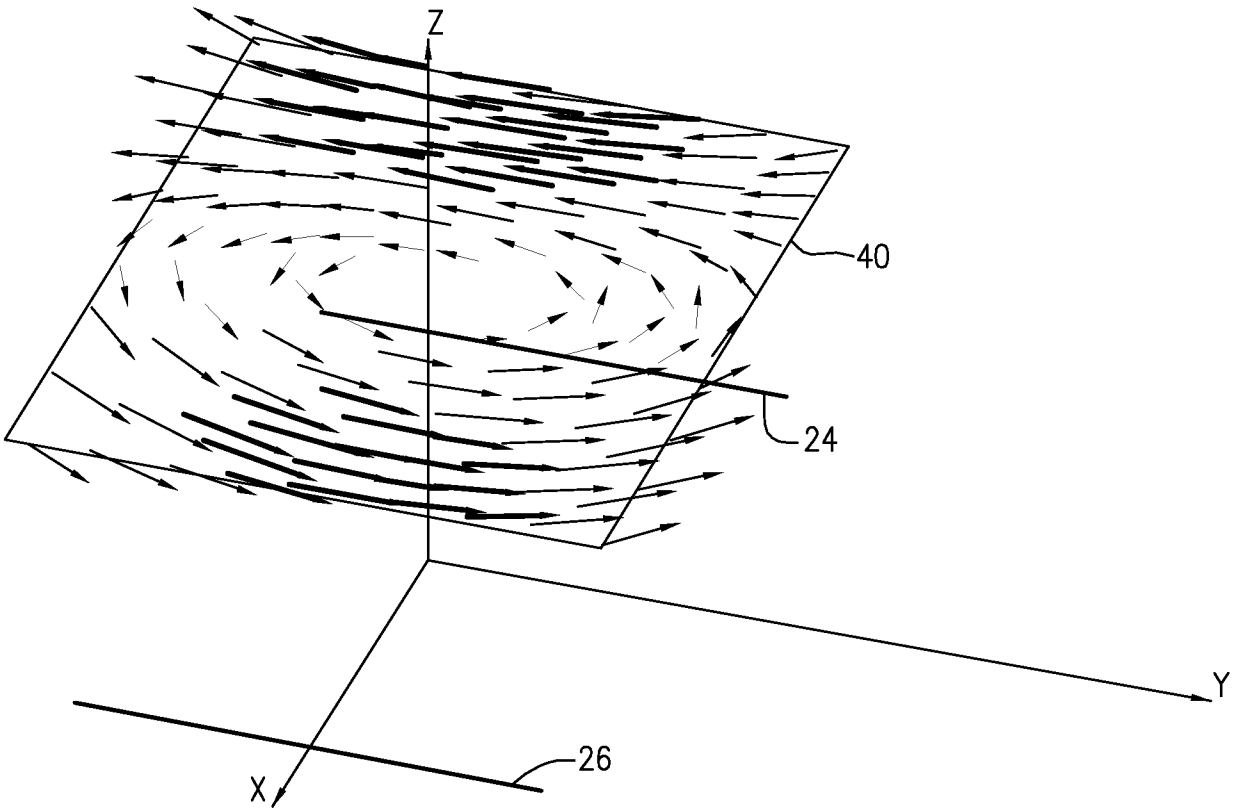
FIG. 6 is a graph of an electric field in a near field plane above the antenna elements shown in FIG. 2 for a 10 cm height and a 250 mm separation.

FIG. 6 is an illustration of the electric field in the plane 40 that is 10 cm above the antenna depicted in FIG. 2 for the distance, d, being 250 mm. In FIG. 6, the peak E-field is greater than the peak E-field of FIG. 5. Thus, the peak E-field increases as the distance, d, between the dipole elements increases. Also, as the separation, d, between the dipole elements increases and becomes significantly larger than the dipole length, the size of the deactivation device grows, and the null zone between the dipole elements increases. On the other hand, as the dipole length becomes comparable to the separation distance, d, detuning of the antenna in the operating band may be reduced.

Figure 7:
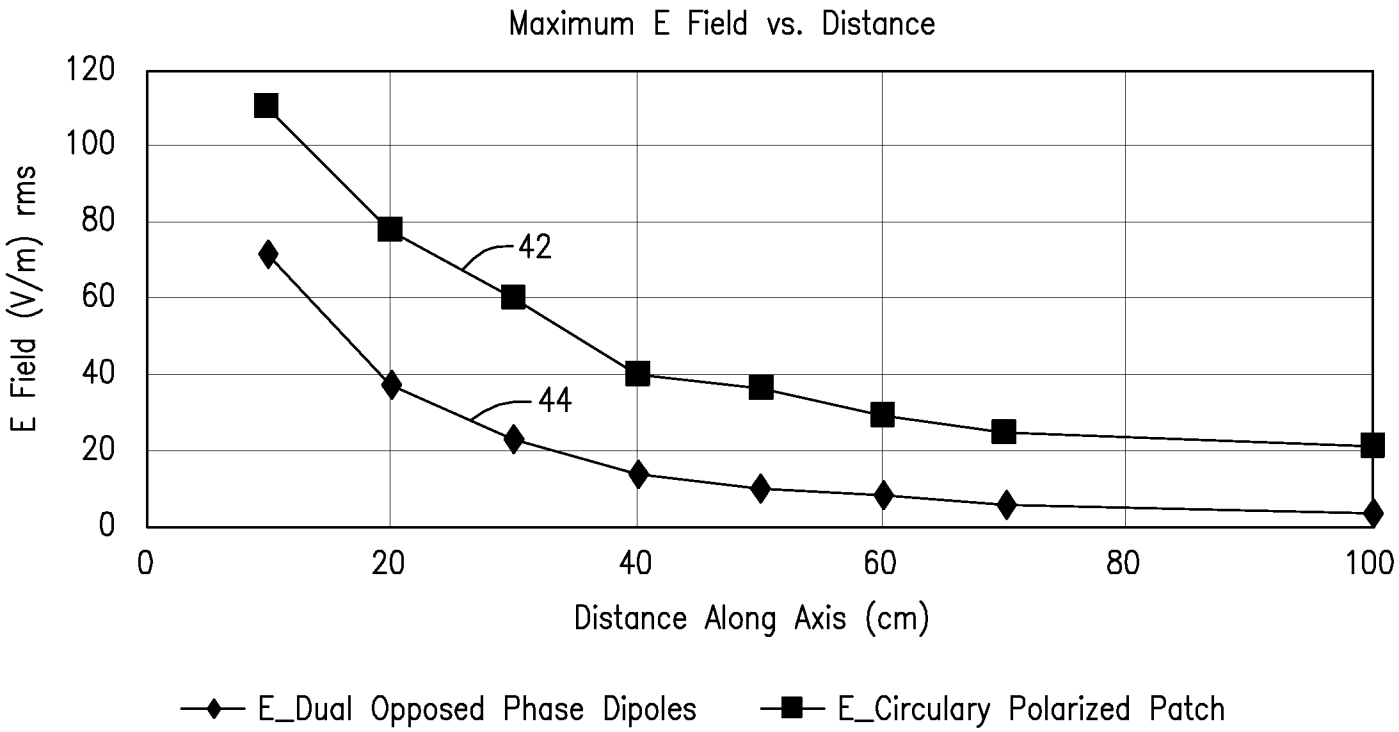
FIG. 7 is a plot of electric field versus distance from a plane containing a circular patch antenna and a plane containing the antenna elements shown in FIG. 2.

FIG. 7 is a graph of the maximum E-field versus distance along the axis perpendicular to a circular patch antenna and to the antenna configuration of FIG. 2. For FIG. 7, the excitation applied to the circular patch antenna is 1 Watt (W rms), whereas the excitation applied to the dipole antenna is 2 W rms, i.e., 1 W rms into each branch of the dipole. The magnitude 44 of the E-field of the dual half-wavelength dipole array of FIG. 2 starts at about 68% of the magnitude 42 of the E-field of the circular patch antenna at a distance of 10 cm above the plane of the antenna. As the distance increases to 100 cm, the magnitude of the E-field for the dual half-wavelength opposed phased dipoles of FIG. 2 is about 18% of the magnitude of the E-field of the circular patch antenna, indicating the increased fall off rate of the dipole antenna of FIG. 2.

Figure 8:
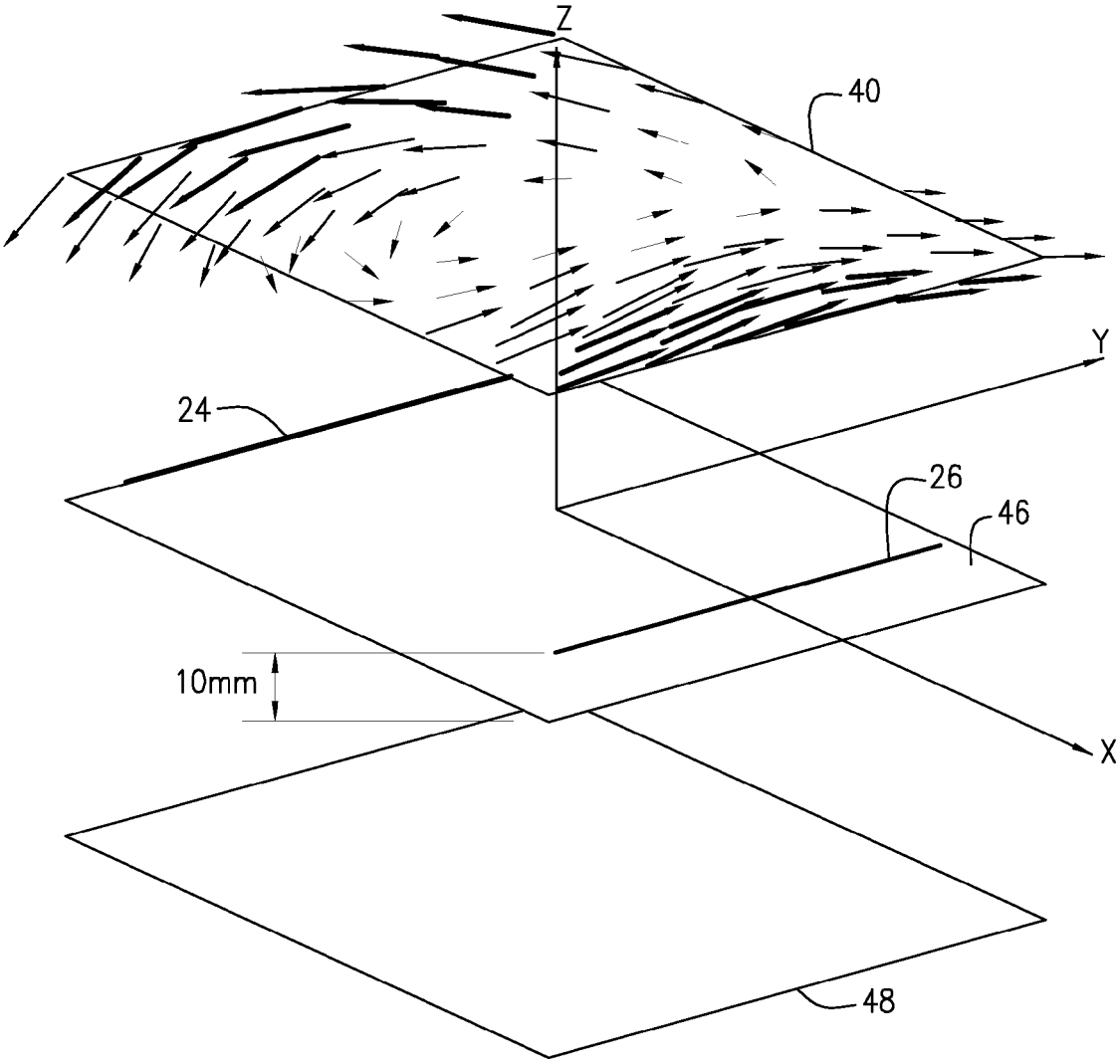
FIG. 8 is a graph of an electric field in a near field plane above the antenna elements shown in FIG. 2 positioned 10 mm above a ground plane.

FIG. 8 shows the field plane 40 of the dipole antenna of FIG. 2 situated above a ground plane 46 that is 10 mm from the antenna plane containing the dipole elements 24 and 26. In the configuration of FIG. 8, there is a strong reduction of the E-field magnitude in a plane 48 below the ground plane 46. The peak E-field in plane 40 decreases from the 74 volt/meter level of FIG. 6 to a level of 41 volts/meter in FIG. 8.

Figure 9:
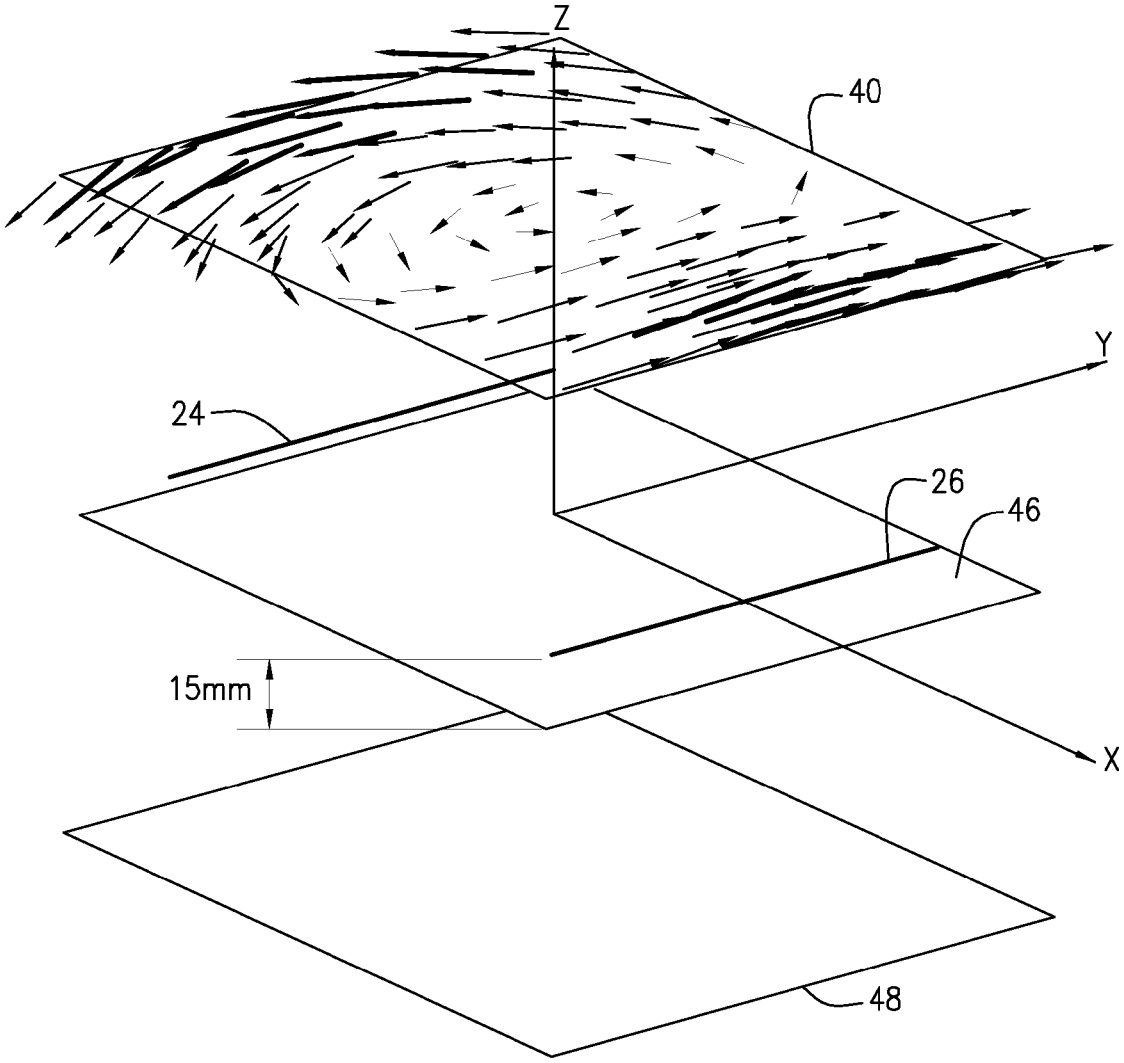
FIG. 9 is a graph of an electric field in a near field plane above the antenna elements shown in FIG. 2 positioned 15 mm above a ground plane.

FIG. 9 shows the field plane 40 of the dipole antenna of FIG. 2 situated above a ground plane 46 that is 15 mm from the antenna plane containing the dipole elements 24 and 26. The gap is about 0.03 times the wavelength at an operating frequency of 900 Megahertz (MHz) Comparing FIGS. 8 and 9 shows that increasing the ground plane distance from the dipole plane by 50% does not substantially decrease the E-field above the antenna in plane 40. The E-field in plane 40 of FIG. 9 is about 95% as strong as the E-field in plane 40 in FIG. 8. However, the increase in ground plane distance does substantially reduce the E-field below the ground plane.

Figure 10:
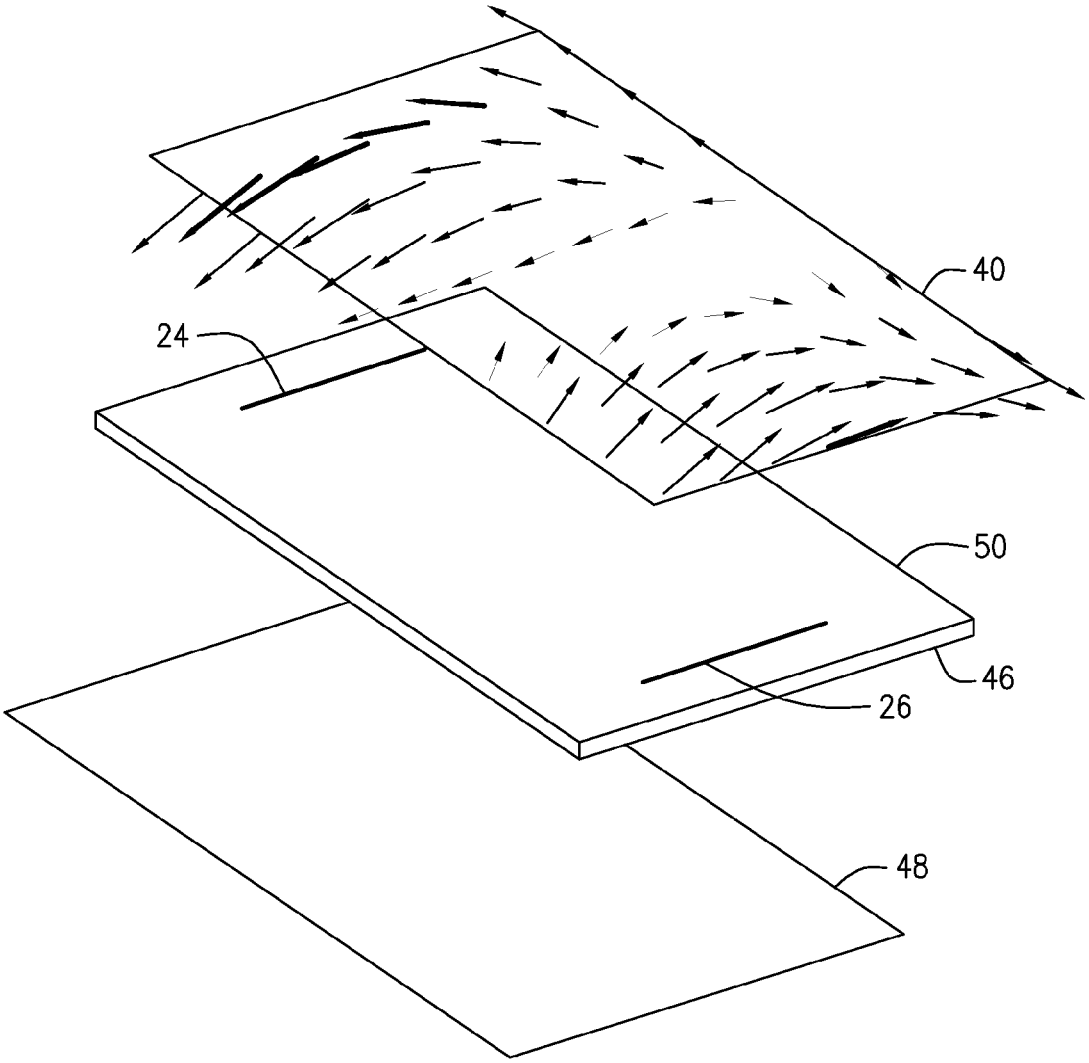
FIG. 10 is a graph of an electric field in a near field plane above the antenna elements shown in FIG. 2 positioned above a 6 mm thick dielectric substrate 21 mm above a ground plane.

FIG. 10 shows the E-field in the plane 40 that is 10 cm above the plane containing the dipole elements 24 and 26 disposed on an FR4 dielectric substrate 50 that is 6 mm thick. A ground plane 46 is disposed on the bottom of the dielectric 50, i.e., on the side opposite the dipole elements 24 and 26. While introduction of the dielectric substrate 50 reduces the overall size or footprint of the deactivator, a significant reduction in the peak E-field above the deactivator is also incurred. In particular, the peak E-field in plane 40 in FIG. 10 is about 26 volts/meter as compared to the 74 volts/meter in plane 40 of the configuration of FIG. 6. This E-field in plane 40 is sufficient to deactivate and EAS tag. Note also, that the introduction of the dielectric substrate 50 enables use of shorter dipole lengths.

Figure 11:
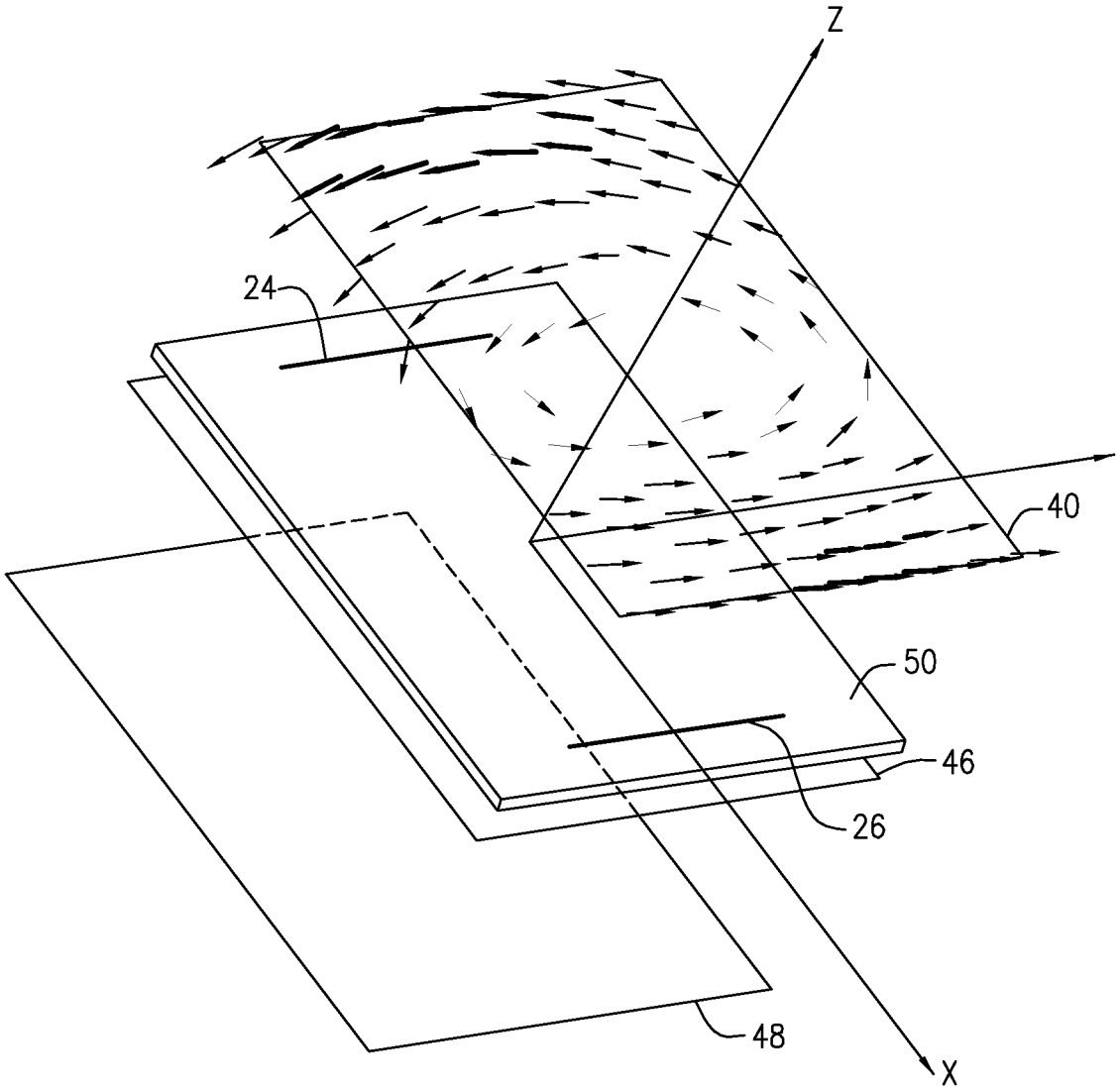
FIG. 11 is a graph of an electric field in a near field plane above the antenna elements shown in FIG. 2 positioned above a dielectric above a ground plane.

FIG. 11 shows the E-field in the plane 40 that is 10 cm above the plane containing the dipole elements 24 and 26 disposed on the 6 mm thick dielectric substrate 50, with a ground plane 46 that is 21 mm below the plane of the antenna elements 24 and 26. The increased distance between the ground plane 46 and the plane of the antenna elements, the reduced length of the radiating dipole elements, and the dielectric loss of the FR4 substrate material causes a reduction of the E-field in plane 40 of about 15% as compared to the embodiment of FIG. 6.

Thus, in some embodiments, a pair of half-wavelength dipole elements are spaced apart about 0.5λ to 1.0λ, where λ is the wavelength of the excitation signal applied to the dipole antenna. The length of the dipoles can be tuned for operation in a specified frequency band such as within 800 to 1000 MHz. For example, the overall length of the dipole elements may be 158 millimeters (mm) in order to resonate at about 900 Megahertz, (MHz).

In some embodiments, two pairs of half-wavelength dipole elements are positioned as shown in FIG. 3, and the excitation applied to the two pairs is alternated between the first pair and the second pair. In some embodiments, a ground plane is placed underneath a plane containing the antenna elements at a distance of about 0.031λ from the antenna plane. A dielectric between the ground plane and the antenna plane may be air or a dielectric having a relative permittivity greater than one. Further, although the drawing figures are for straight dipole elements, meander line elements having dipole characteristics may be used instead.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

What is claimed is:

1. A near field antenna, comprising:

a first antenna element having a dimension that is about a half wavelength of an excitation frequency, the excitation frequency carried by a first signal applied to the first antenna element with a first relative phase to provide a first electric field;

a second antenna element having a dimension that is about a half wavelength of the excitation frequency, the first signal being applied to the second antenna element with a second relative phase of about 180 degrees from the first relative phase to provide a second electric field that substantially cancels out the first electric field in a far field when the excitation frequency is in the range of about 800 to about 1000 Megahertz (MHz), the second antenna element being substantially parallel to the first antenna and being displaced from the first antenna element by about a half wavelength of the excitation frequency.

2. The near field antenna of claim 1, wherein the first and second antenna elements are dipoles and the first signal is applied at a center of the first dipole at a relative phase of about zero and the first signal is applied at a center of the second dipole at a relative phase of about 180 degrees.

3. The near field antenna of claim 1, wherein the first antenna element and the second antenna element are configured to produce, in combination, a strong near field when the excitation frequency is in the range of about 800 to about 1000 Megahertz (MHz).

4. The near field antenna of claim 1, further comprising:

a third antenna element oriented substantially at a right angle to the first antenna element, the third antenna element having a dimension that is about a half wavelength of the excitation frequency, the excitation frequency carried by a second signal applied to the third antenna element with a third relative phase; and a fourth antenna element oriented substantially at a right angle to the second antenna element, the fourth antenna element having a dimension that is about a half-wavelength of the excitation frequency, the second signal being applied to the fourth antenna element with a fourth relative phase of about 180 degrees from the third relative phase, the fourth antenna element being displaced from the third antenna element by about a half wavelength of the excitation frequency.

5. The near field antenna of claim 4, wherein the first signal and the second signal are applied to the first antenna element and the third antenna element, respectively, in alternating time intervals such that, in a first time interval, the first antenna element is excited and the third antenna element is not excited and, in a next subsequent time interval, the first antenna element is not excited and the third antenna element is excited.

6. The near field antenna of claim 4, wherein each of the first, second, third and fourth antenna elements are phased 90 degrees apart from a nearest antenna element.

7. The near field antenna of claim 1, further comprising a ground plane, the ground plane being separated from a plane containing the first and second antenna elements by a predetermined distance.

8. The near field antenna of claim 7, wherein the predetermined distance is about 0.03 times the wavelength of the excitation frequency.

9. The near field antenna of claim 7, wherein the predetermined distance defines a gap, the gap being filled by a dielectric.

10. A method of producing an electromagnetic field for deactivating an electronic article surveillance, EAS, tag, the method comprising:

providing an excitation frequency;

providing an array of dipole elements, each dipole element having a dimension of about a half wavelength of the excitation frequency, the array of dipole elements having a dipole element spacing of about a half wavelength; and applying the excitation frequency to the array of dipole elements so that pairs of dipole elements in the array are phased apart by 180 degrees.

11. The method of claim 10, wherein the array of dipole elements are configured to provide a far field that is substantially zero when the excitation frequency is in the range of about 800 to about 1000 Megahertz (MHz).

12. The method of claim 10, wherein each dipole element of the array of dipole elements is oriented at right angles to another dipole element of the array.

13. The method of claim 10, wherein the dipole elements are meander lines.

14. The method of claim 10, wherein the excitation frequency is applied in a manner to produce a null substantially perpendicular to a plane containing the array of dipole elements.

15. A near field antenna system for deactivation of an electronic article surveillance tag, the near field antenna system comprising:

a first antenna element having a dimension of about 160 millimeters (mm);

a second antenna element having a dimension of about 160 mm, the second antenna element being substantially parallel to, and spaced apart from, the first antenna element by a distance in a range of about 100 mm to about 250 mm; and a signal generator generating an excitation signal in a range of about 800 to about 1000 Megahertz (MHz), the excitation signal being applied to the first and second antenna elements so that a phase of excitation of the first antenna is 180 degrees from a phase of excitation of the second antenna element.

16. The near field antenna system of claim 15, wherein the first antenna element is oriented 180 degrees from an orientation of the second antenna element.

17. The near field antenna system of claim 16, further comprising:

a third antenna element having a dimension of about 160 mm; and a fourth antenna element having a dimension of about 160 mm, the fourth antenna element being spaced apart from the third antenna element by a distance in a range of about 100 mm to about 250 mm; the third and fourth antenna elements being oriented about 90 degrees from the first and second antenna elements.

18. The near field antenna system of claim 15, wherein the antenna elements are dipoles and the excitation signal has a power of about 1 Watt.

19. The near field antenna system of claim 18, wherein the first antenna element is configured to provide a first electric field; and the second antenna element is configured to provide a second electric field that substantially cancels out the first electric field in a far field when the excitation signal is in a range of about 900 to about 950 MHz.

* * * * *